United States Patent [19]

Ohba et al.

[11] Patent Number: 4,893,060

[45] Date of Patent: Jan. 9, 1990

[54] DRIVE CIRCUIT FOR A THIN-FILM ELECTROLUMINESCENT DISPLAY PANEL

[75] Inventors: Toshihiro Ohba; Yoshiharu Kanatani, both of Nara; Hisashi Uede, Wakayama, all of Japan

[73] Assignee: Sharp Kabushiki Kaisha, Osaka, Japan

[21] Appl. No.: 186,743

[22] Filed: Apr. 25, 1988

Related U.S. Application Data

[63] Continuation of Ser. No. 664,958, Oct. 26, 1984, abandoned.

[30] Foreign Application Priority Data

Oct. 31, 1983 [JP] Japan ..... 58-206514

[51] Int. Cl.[4] ..... H01J 19/14

[52] U.S. Cl. ..... 315/169.3; 315/169.2; 340/781; 340/825.81

[58] Field of Search ..... 315/169.3, 169.2, 107; 340/781, 825.81

[56] References Cited

U.S. PATENT DOCUMENTS 3,885,196 5/1975 Fischer ..... 340/781

4,338,598 7/1982 Ohba et al. ..... 340/825.81

4,485,379 11/1984 Kinoshita et al. ..... 340/825.81

OTHER PUBLICATIONS

Nikkei Electronics, Apr. 2, 1979, "Practical Applications of Thin-Film Electroluminescent (EL) Character Display."

*Primary Examiner*—Robert L. Griffin
*Assistant Examiner*—T. Salindong
*Attorney, Agent, or Firm*—Birch, Stewart, Kolasch & Birch

[57] ABSTRACT

A drive circuit for a thin-film electroluminescent (EL) matrix display panel includes an odd side N-ch high voltage MOS driver, and an odd side P-ch high voltage MOS driver connected to odd number scanning electrodes of the thin-film electroluminescent (EL) matrix display panel. Even number scanning electrodes of the thin-film electroluminescent (EL) matrix display panel are connected to an even side N-ch high voltage MOS driver and an even side P-ch high voltage MOS driver. The four MOS drivers are effectively controlled to perform an alternating current driving of the thin-film electroluminescent (EL) matrix display panel.

16 Claims, 5 Drawing Sheets

DRIVE CIRCUIT FOR A THIN-FILM ELECTROLUMINESCENT DISPLAY PANEL

This application is a continuation of application Ser. No. 664,958 filed on Oct. 26, 1984, now abandoned.

BACKGROUND AND SUMMARY OF THE INVENTION

The present invention relates to a drive circuit for a high-voltage alternating current driving capacitive flat matrix display panel and, more particularly, to a drive circuit for a thin-film electroluminescent matrix display panel.

The conventional drive circuit for a thin-film electroluminescent (EL) matrix display panel includes high-voltage N-ch MOS drivers performing a pull-down function, and diodes performing a pull-up function. An example of the conventional drive circuit is disclosed in Nikkei Electronics, Apr. 2, 1979, "Practical Applications of Thin-Film Electroluminescent (EL) Character Display".

In such a conventional drive circuit, the phase relationship between the write pulse and the field refresh pulse sequentially varies depending on the scanning electrodes. Also, the pre-charging voltage produces a D.C. voltage depending on whether the data side electrode is selected or not. Furthermore, the amplitudes of the write voltage and the refresh pulse are asymmetrical to each other. This fact creates deterioration in the voltage-brightness characteristics of the alternating current driving thin-film electroluminescent (EL) matrix display panel. Therefore, the conventional drive circuit can not ensure a stable operation of the thin-film electroluminescent (EL) matrix display panel for a long time.

Accordingly, an object of the present invention is to provide a novel drive circuit which ensures a stable operation of an alternating current driving capacitive type thin-film electroluminescent (EL) display panel for a long time.

Another object of the present invention is to provide a drive circuit for a thin-film electroluminescent (EL) matrix display panel, which minimizes deterioration of the voltage-brightness characteristics of the thin-film electroluminescent (EL) matrix display panel.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a scanning side drive circuit for a thin-film electroluminescent (EL) matrix display panel includes a P-ch MOS driver performing a pull-up function in addition to an N-ch MOS driver performing a pull-down function. The N-ch MOS driver and the P-ch MOS driver are combined with each other in a predetermined timing relationship. More specifically, the N-ch MOS driver and the P-ch MOS driver are alternately activated so that the polarity of the voltage applied to the thin-film electroluminescent (EL) matrix display panel is inverted field by field. The phase relationship between the positive and negative pulses applied to the thin-film electroluminescent (EL) display panel is fixed. Also, the amplitudes of the positive and negative pulses applied to the thin-film electroluminescent (EL) display panel are symmetrical.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
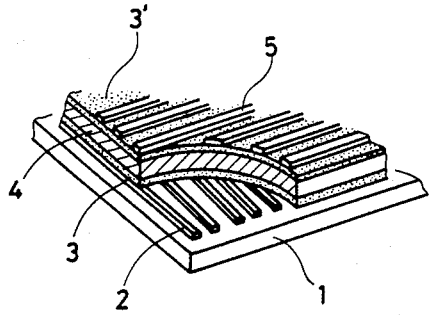
FIG. 1 is a partially cut-away perspective view of a thin-film electroluminescent (EL) matrix display panel.

FIG. 1 shows a general construction of a double insulation (three-layered construction) thin-film electroluminescent (EL) matrix display panel.

The double insulation (three-layered construction) thin-film electroluminescent (EL) matrix display panel generally includes a glass substrate 1, and strip shaped $In_2O_3$ transparent electrodes 2 formed on the glass substrate 1. A first dielectric layer 3 made of, for example, $Y_2O_3$, $Si_3N_4$, $TiO_2$ or $Al_2O_3$ is formed on the transparent electrodes 2. A ZnS electroluminescent (EL) layer 4 doped with an activator such as Mn is formed on the first dielectric layer 3. A second dielectric layer 3' made of, for example, $Y_2O_3$, $Si_3N_4$, $TiO_2$ or $Al_2O_3$ is formed on the electroluminescent (EL) layer 4 so as to sandwich the electroluminescent (EL) layer 4 by the pair of dielectric layers 3 and 3'. These layers 3, 4 and 3' have a thickness of about 500 through 10000 Å, and are formed using the thin-film deposition technique such as an evaporation method and a sputtering method. Strip shaped $Al_2O_3$ rear electrodes 5 are formed on the second dielectric layer 3' in a direction perpendicular to the transparent electrodes 2.

Figure 2:
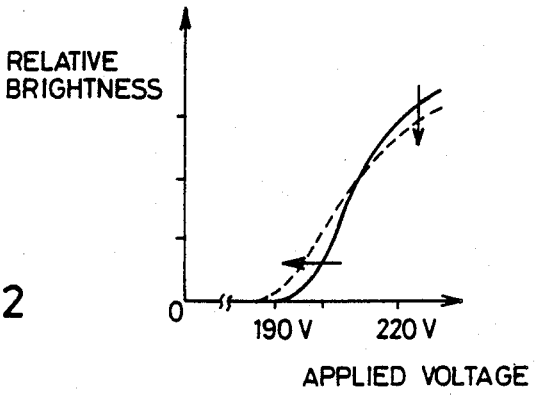
FIG. 2 is a graph showing the brightness versus applied voltage characteristics of a thin-film electroluminescent (EL) display device.

The above-mentioned double insulator thin-film electroluminescent (EL) matrix display panel includes the electroluminescent (EL) layer 4 disposed between the pair of dielectric layers 3 and 3'. Therefore, the display panel can be considered to be equivalent to a capacitive element. Further, it will be clear from FIG. 2 that the thin-film electroluminescent (EL) display panel is driven by a considerably high voltage of about 200 V. In FIG. 2, the solid line shows the brightness versus applied voltage chracteristics of the thin-film electroluminescent (EL) display panel of the above-mentioned construction.

Figure 3:
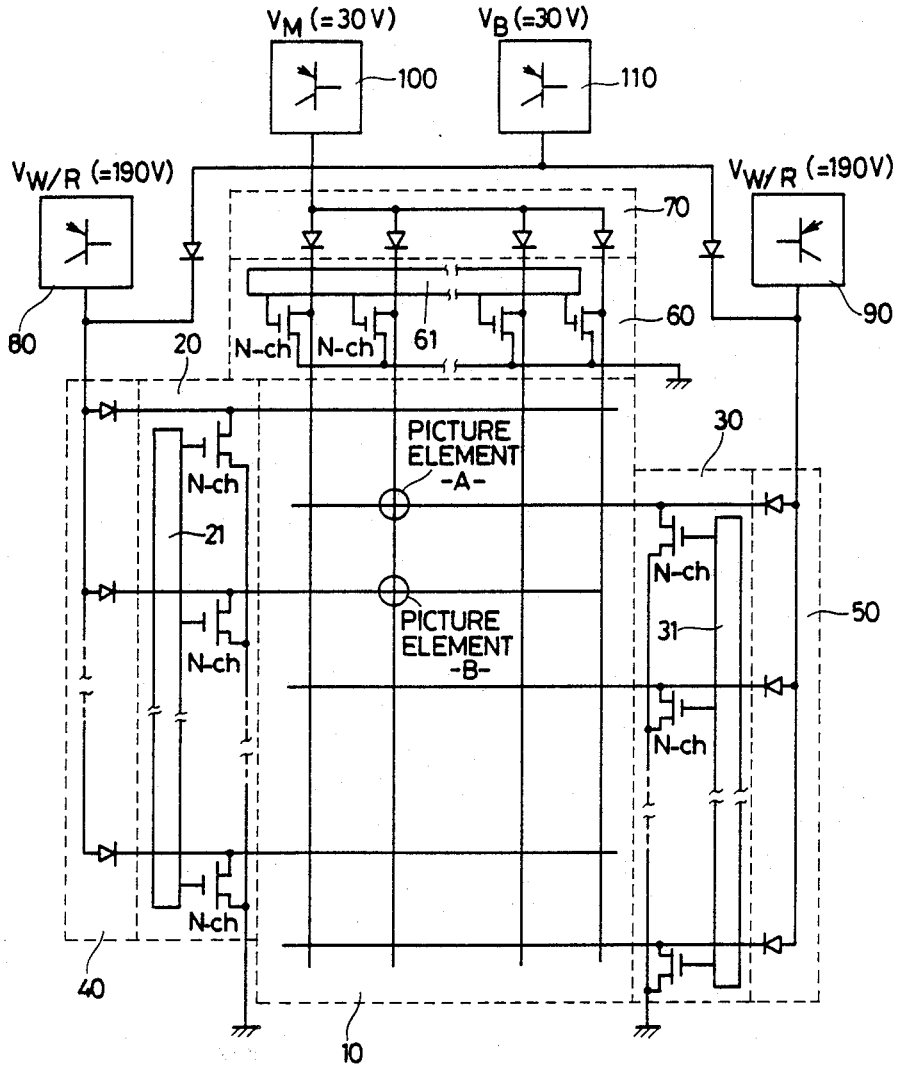
FIG. 3 PRIOR ART
FIG. 3 is a circuit diagram of a drive circuit for a thin-film electroluminescent (EL) matrix display panel of the prior art.

FIG. 3 shows an example of a conventional drive circuit for the thin-film electroluminescent (EL) matrix display panel of FIG. 1.

The thin-film electroluminescent (EL) matrix display panel of the above-mentioned construction is designated 10 and includes a plurality of data side electrodes and a plurality of scanning side electrodes. The intersection of each said data side electrode and each said scanning side electrode forms a picture element (A and B of FIG. 3 are exemplary) or pixel. Scanning side N-ch MOS ICs 20 and 30 are connected to the scanning side electrodes. The scanning side electrodes are alternately arranged in first and second groups driven respectively by said scanning side N-channel MOS ICs 20,30. The scanning side N-ch MOS IC 20 includes a logic circuit 21 such as a shift register. The scanning side N-ch MOS IC 30 includes a logic circuit 31 such as a shift register. A diode array 40 includes a plurality of diodes the anodes of which are commonly connected to each other. Each cathode of the plurality of diodes is connected to one of the odd number scanning side electrodes. The diode array 40 separates the scanning side driving lines, and functions to protect switching elements from the reversed bias. Another diode array 50 includes a plurality of diodes the anodes of which are commonly connected to each other. Each cathode of the plurality of diodes is connected to one of the even number scanning side electrodes. The diode array 50 functions to separate the scanning side driving line, and to protect switching elements from the reversed bias. A data side N-ch MOS IC 60 is connected to the data side electrodes. The data side N-ch MOS IC 60 includes a logic circuit 61 such as a shift register. A data side diode array 70 is provided for separating the data side driving line, and for protecting high voltage transistor switching elements, which will be described later, from the reversed bias. The drive circuit of FIG. 3 further includes write/refresh driving circuits 80 and 90, a pre-charge driving circuit 100, and a pull-up charge driving circuit 110.

Figure 4:
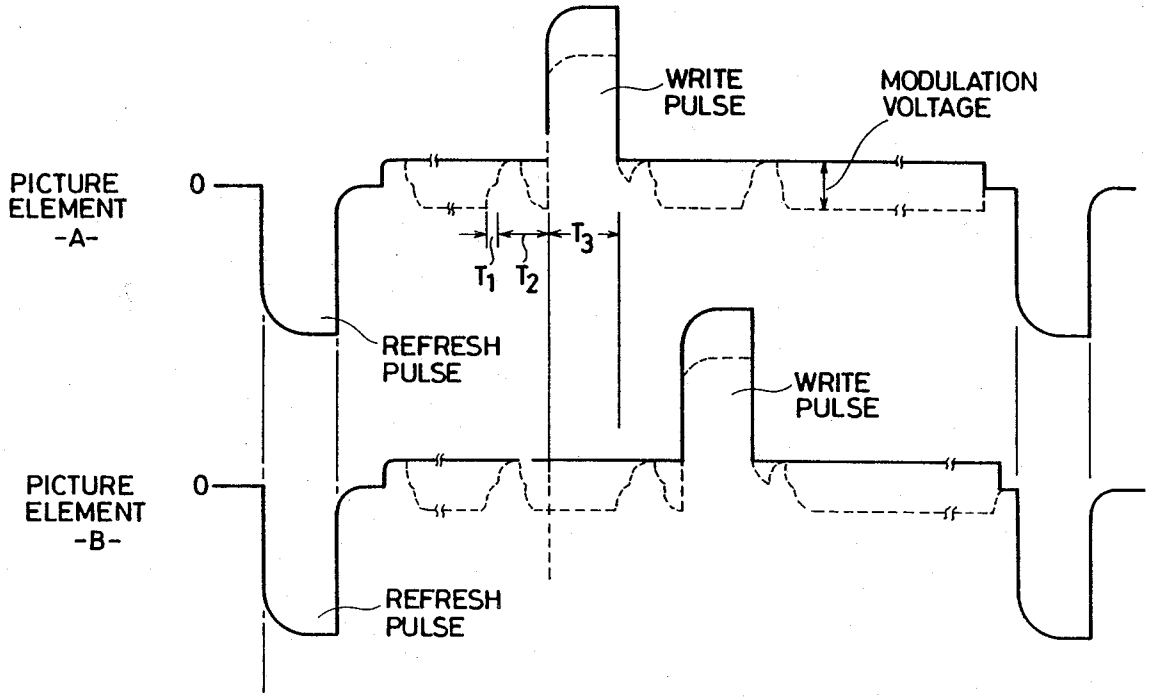
FIG. 4 PRIOR ART
FIG. 4 is a timing chart showing voltage signals applied to picture elements A and B in the thin-film electroluminescent (EL) matrix display panel of FIG. 3.

An operational mode of the conventional drive circuit of FIG. 3 will be described with reference to a time chart of FIG. 4. FIG. 4 shows voltage signals applied to picture elements A and B shown in FIG. 3.

First Stage $T_1$: Pre-Charge Period

All high voltage MOS transistors included in the scanning side ICs 20 and 30 are placed in the ON state. At the same time, the pre-charge driving circuit 100 is placed in the ON state, while all the MOS transistors included in the data side IC 60 are held in the OFF state, thereby charging the entire panel via the data side diode array 70. Consequently, all scanning side electrodes bear 0 V, and all data side driving electrodes bear 30 V.

Second Stage $T_2$: Pull-Up Charge/Discharge Period

All MOS transistors included in the scanning side ICs 20 and 30 are switched OFF. The pull-up charge driving circuit 110 is switched ON so as to pull-up all scanning side electrodes to 30 V via the scanning side diode arrays 40 and 50. The entire data side driving electrodes are pulled up to 60 V because the electrodes are capacitively coupled with each other at the picture elements of the thin-film electroluminescent (EL) matrix display panel. Thereafter, only a MOS transistor connected to a selected data side driving electrode included in the IC 60 is maintained OFF with the remaining MOS transistors included in the IC 60 being switched ON to discharge the charges from the non-selected data side electrodes. That is, the selected data side electrode is maintained at 60 V, while the non-selected data side electrodes bear 0 V. Since the entire scanning side electrodes are pulled up to 30 V, the selected data side electrode is +30 V with respect to the scanning side electrodes, and the non-selected data side electrodes are −30 V with respect to the scanning side electrodes.

Third Stage $T_3$: Write-In Drive Period

When one of the even number scanning side electrodes is selected, the odd side write/refresh driving circuit 80 is switched ON so as to pull up all the odd number scanning side electrodes to +190 V via the scanning side diode array 40. Due to the capacitive coupling construction, the selected data side driving electrode is pulled up to +220 V, and the non-selected data side driving electrodes are pulled up to +160 V. Then, the MOS transistor included in the IC 30 and connected to the selected scanning side electrode is switched ON whereby the selected scanning side electrode bears 0 V. Consequently, the selected picture element receives a write-in voltage 220 V (peak value) which is sufficient for the electroluminescence. The non-selected picture elements on the selected scanning side electrodes receive the voltage of 160 V (peak value) which is less than the threshold level.

As discussed above, the selected data side driving electrode is pulled up to +220 V, and the non-selected data side driving electrodes are pulled up to +160 V. However, the selected data side electrode is maintained at +30 V with respect to the odd number scanning side electrodes and the non-selected even number scanning side electrodes. And the non-selected data side electrodes are maintained at −30 V with respect to the odd number scanning side electrodes and the non-selected even number scanning side electrodes. That is, the condition is same as the second stage $T_2$.

When one of the odd number scanning side electrodes is selected, the even side write/refresh driving circuit 90 is switched ON so as to pull up all the even number scanning side electrodes to +190 V via the scanning side diode array 50.

Application of a Refresh Pulse of Opposite Polarity after Write-In Operation The above-mentioned write-in operation is conducted for each of the scanning side electrodes. When the write-in operation for the entire image screen is completed, all the data side transistors included in the IC 60 are switched ON, and both the write/refresh driving circuits 80 and 90 are switched ON. A refresh pulse having an amplitude of 190 V and a polarity opposite to the write-in voltage is applied to the entire panel via the scanning side diode arrays 40 and 50.

In FIG. 4, the solid line shows a condition when the data side electrode is selected in the above-mentioned three staged write-in operation. And the broken line shows a condition when the data side electrode is not selected.

It will be clear from FIG. 4 that the phase relationship between the write-in pulse and the refresh pulse sequentially varies depending on the scanning side electrodes in the conventional drive circuit. And the pre-charge voltage produces a D.C. voltage depending on whether the data side electrode is selected or not. Furthermore, the amplitudes of the write-in pulse and the refresh pulse are asymmetrical to each other. Therefore, deterioration is created in the voltage-brightness characteristics of the alternating current driving thin-film electroluminescent (EL) matrix display panel. More specifically, the voltage-brightness characteristics deteriorate in a manner, for example, as shown by the broken line in FIG. 2. Accordingly, the conventional drive circuit can not ensure a stable operation of the thin-film electroluminescent (EL) matrix display panel for a long time.

Figure 5:
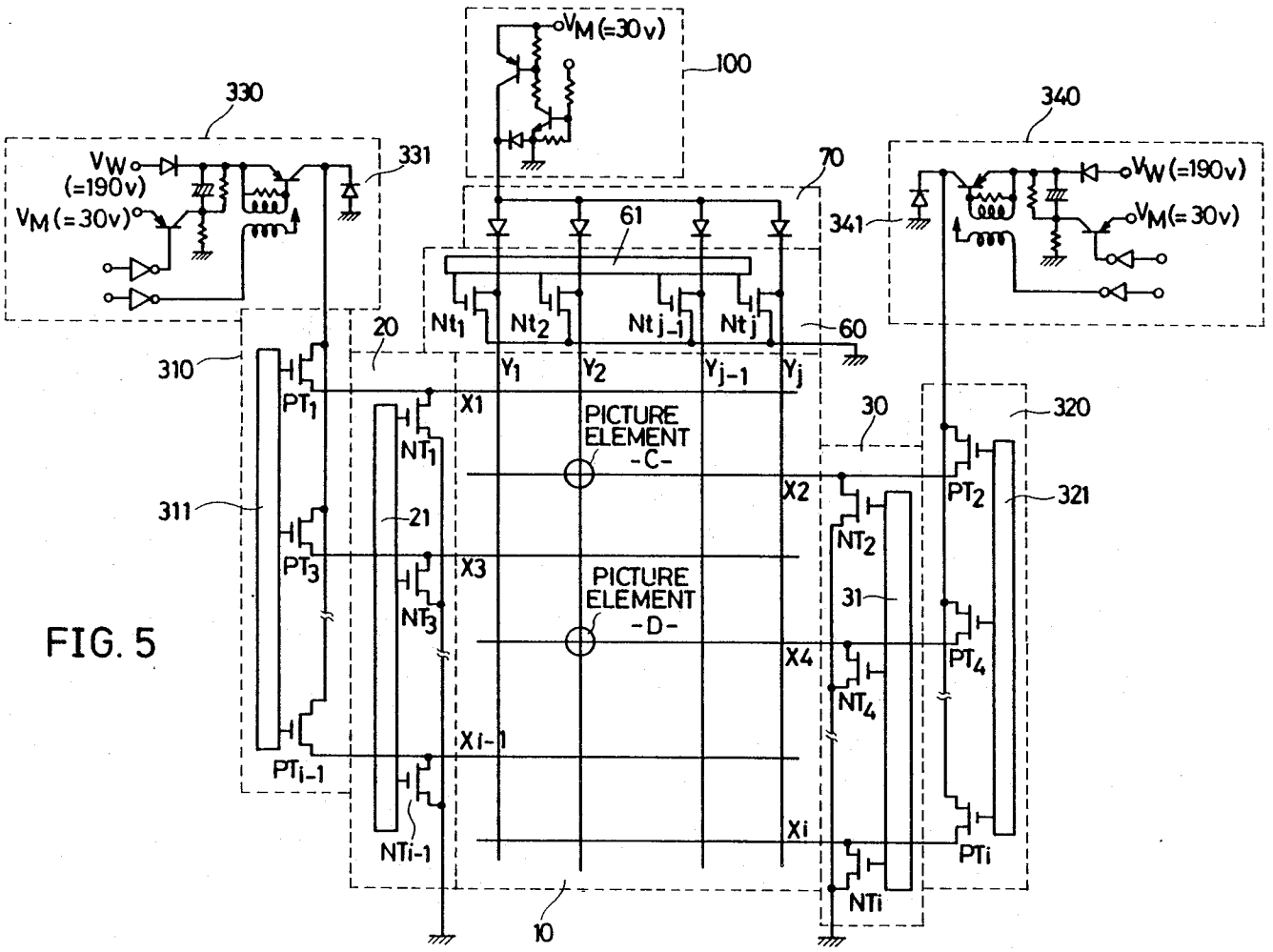
FIG. 5 is a circuit diagram of an embodiment of a drive circuit for a thin-film electroluminescent (EL) matrix display panel of the present invention.

FIG. 5 shows an embodiment of a drive circuit of the present invention. Like elements corresponding to those of FIG. 3 are indicated by like numerals.

An odd side P-ch high voltage MOS IC 310 is provided instead of the scanning side diode array 40. The odd side P-ch high voltage MOS IC 310 includes a logic circuit 311 such as a shift register. An even side P-ch high voltage MOS IC 320 is provided instead of the scanning side diode array 50. The even side P-ch high voltage MOS IC 320 includes a logic circuit 321 such as a shift register. An odd side write driving circuit 330 and an even side write driving circuit 340 are provided.

An operational mode of the drive circuit of FIG. 5 will be described with reference to a time chart of FIG. 6. In the following explanation, a scanning side electrode $X_2$ including a picture element or pixel C is selected as the selected scanning side electrode. In accordance with the present invention, the polarity of the applied voltage signal is inverted field by field. The first field or group is referred to as the odd field, and the second field or group is referred to as the even field.

Odd Field First Stage $T_1$: Pre-Charge Period

MOS transistors $NT_1$ through $NT_i$ included in the scanning side N-ch MOS ICs 20 and 30 are placed in the ON state. At the same time, the pre-charge driving circuit 100 (voltage $V_M$) is switched ON so as to charge the entire panel via the data side diode array 70. During the pre-charge period, the MOS transistors $Nt_1$ through $Nt_j$ included in the data side N-ch MOS IC 60, and the MOS transistors $PT_1$ through $PT_i$ included in the scanning side P-ch MOS ICs 310 and 320 are held in the OFF state.

Odd Field Second Stage $T_2$: Discharge Period

The MOS transistors $NT_1$ through $NT_i$ included in the scanning side N-ch MOS ICs 20 and 30 are switched OFF. One of the MOS transistors included in the data side N-ch MOS IC 60 and connected to a selected data side driving electrode is maintained OFF while the remaining MOS transistors included in the data side N-ch MOS IC 60 are switched ON. Further, the MOS transistors $PT_1$ through $PT_i$ included in the scanning side P-ch MOS ICs 310 and 320 are switched ON. The charges on the non-selected data side electrodes are discharged through a grounded loop formed, in combination, by the MOS transistors included in the data side N-ch MOS IC 60, MOS transistors $PT_1$ through $PT_i$ included in the scanning side P-ch MOS ICs 310 and 320, and diodes 331 and 341 included in the write driving circuits 330 and 340, respectively. On the other hand, charges on the selected data side electrode are maintained without discharging. In this embodiment, the pull-up charging is not conducted and, therefore, the scanning side electrodes are held at 0 V. Therefore, the selected data side electrode is +30 V with respect to the scanning side electrodes, and the non-selected data side electrodes are 0 V with respect to the scanning side electrodes.

Odd Field Third Stage $T_3$: Write-In Drive Period

Only one MOS transistor $NT_2$ included in the scanning side N-ch MOS IC 30 and connected to the selected scanning side electrode $X_2$ is switched ON, and MOS transistors $PT_2$ through $PT_i$ included in the even side P-ch MOS IC 320 are switched OFF. All MOS transistors $PT_1$ through $PT_{i-1}$ included in the odd side P-ch MOS IC 310 are held at the ON state. Thus, all the odd number scanning side electrodes are pulled up to +190 V via the MOS transistors $PT_1$ through $PT_{i-1}$ included in the scanning side P-ch MOS IC 310. Since only the MOS transistor $NT_2$ included in the scanning side MOS IC 30 and connected to the selected scanning side electrode $X_2$ is in the ON state, due to the capacitive coupling, the selected data side driving electrode is pulled up to +220 V, and the non-selected data electrodes are pulled up to +190 V.

In the case where one of the odd number scanning side electrodes is selected, all MOS transistors $PT_2$ through $PT_i$ included in the even side P-ch MOS IC 320 are switched ON so as to pull up the entire even number scanning side electrodes to +190 V. The write driving circuits 330 and 340 are switched ON in this third stage $T_3$. More specifically, when one of the odd number scanning side electrodes is selected, the even side write driving circuit 340 is switched ON. When one of the even number scanning side electrodes is selected, the odd side write driving circuit 330 is switched ON. Thus, write driving circuits 330 and 340 function to supply a write voltage of 190 V ($V_W$) in the odd field, and supply a write voltage of 220 V ($V_W+V_M$) in the even field. The above-mentioned three-staged odd field driving is sequentially conducted for each of the scanning side electrodes $X_1$ through $X_i$. Then, similar even field driving is conducted.

Even Field First Stage $T_1'$: Pre-Charge Period

The pre-charge operation is conducted in the same manner as the Odd Field First Stage $T_1$.

Even Field Second Stage $T_2'$: Discharge Period

One of the MOS transistors included in the data side N-ch MOS IC 60 and connected to a selected data side driving electrode is switched ON while the remaining MOS transistors included in the data side N-ch MOS IC 60 and connected to the non-selected data side driving electrodes are held in the OFF state. Charges on the selected data side electrode are discharged through the ON state MOS transistor included in the N-ch MOS IC 60, MOS transistors $PT_1$ through $PT_i$ included in the scanning side P-ch MOS ICs 310 and 320, and the diodes 331 and 341 included in the write driving circuits 330 and 340, respectively.

Even Field Third Stage $T_3'$: Write-In Drive Period

Only the MOS transistor $PT_2$ included in the scanning side P-ch MOS IC 320 and connected to the selected scanning side electrode $X_2$ is held in the ON state, and the entire MOS transistors $NT_1$ through $NT_{i-1}$ included in the odd side scanning N-ch MOS IC 20 are switched ON. The even side write driving circuit 340 is switched ON so as to supply a write voltage of 220 V ($=V_W+V_M$). Due to the capacitive coupling, the selected data side driving electrode is pulled down to −220 V, and the non-selected data side electrodes are pulled down to −190 V.

In the case where one of the odd number scanning electrodes is selected, the odd side write driving circuit 330 is switched ON so as to supply 220 V. At this moment, one of the MOS transistors included in the scanning side P-ch MOS IC 310 and connected to the selected scanning side electrode, and the MOS transistors $NT_2$ through $NT_i$ included in the opposing scanning side N-ch MOS IC 30 are switched ON. The above-mentioned three-staged even field driving is sequentially conducted to the entire scanning side electrodes $X_1$ through $X_i$.

Figure 6:
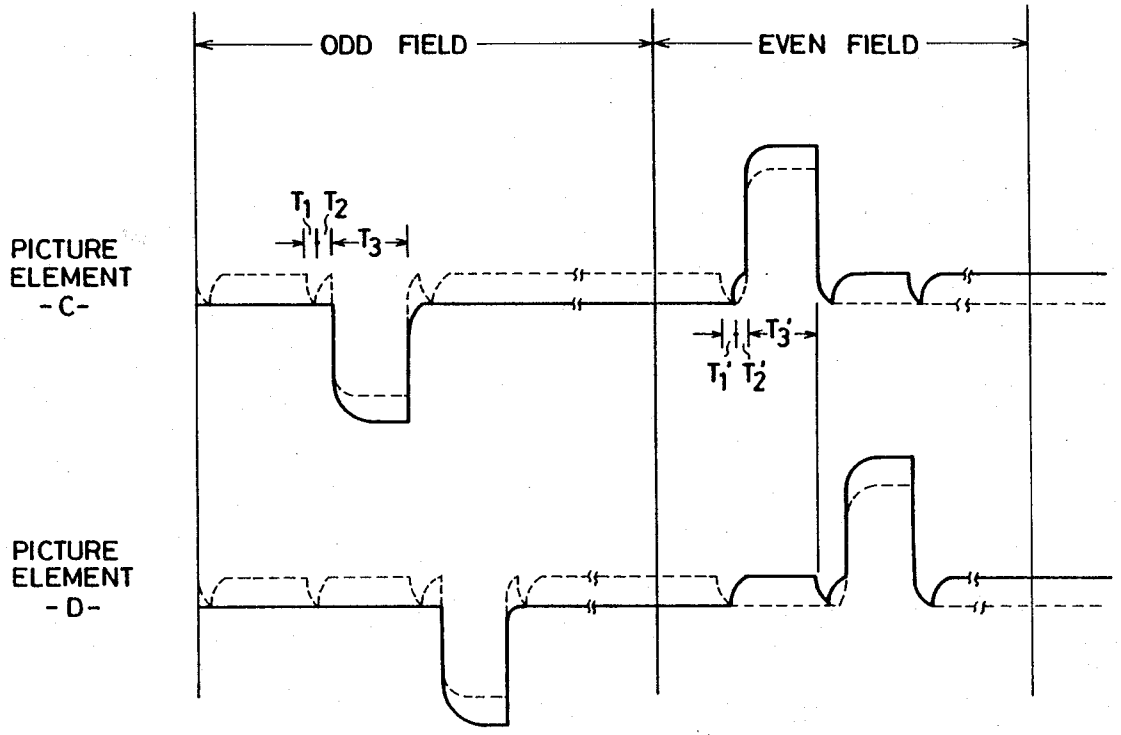
FIG. 6 is a timing chart showing voltage signals applied to picture elements C and D in the thin-film electroluminescent (EL) matrix display panel of FIG. 5.

It will be clear from the time chart of FIG. 6 that the selected picture element receives the write-in voltage of 220 V (peak value) sufficient for the electroluminescence of the first polarity in the odd field and the second polarity opposite to the first polarity in the even field. That is, the alternating current driving for the thin-film electroluminescent (EL) matrix display panel is conducted by the combination of the odd field driving and the even field driving. The non-selected picture elements receive a voltage of 190 V (peak value) which is less than the threshold level.

The phase relationship between the positive pulse and the negative pulse is fixed. Further, the amplitudes of the positive pulse and the negative pulse are symmetrical with each other. That is, a complete alternating current driving is carried out.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A drive circuit for a thin-film electroluminescent (EL) matrix display panel comprising:

data side electrodes formed on one major surface of the thin-film electroluminescent (EL) matrix display panel in one direction;

scanning side electrodes formed on the opposing major surface of said thin-film electroluminescent (EL) matrix display panel in another direction substantially perpendicular to said data side electrodes, said scanning side electrodes being alternately divided into odd number scanning electrodes and even number scanning electrodes;

an odd side write driving circuit supplying a writing pulse to selected even number scanning electrodes in a first drive field and to selected odd number scanning electrodes in a second drive field;

an even side write driving circuit supplying said writing pulse to said selected odd number scanning electrodes in said first drive field and to said selected even number scanning electrodes in said second drive field;

an odd side N-channel high voltage MOS driver connected to said odd number scanning electrodes at one end thereof, the other end of said odd side N-channel high voltage MOS driver being connected to a grounded terminal;

an odd side P-channel MOS high voltage driver connected to said odd number scanning electrodes at one end thereof, the other end of said odd side P-channel MOS high voltage driver being connected to said odd side write driving circuit;

an even side N-channel high voltage MOS driver connected to said even number scanning electrodes at one end thereof, the other end of said even side N-channel high voltage MOS driver being connected to the grounded terminal; and an even side P-channel high voltage MOS driver connected to said even number scanning electrodes at one end thereof, the other end of said even side P-channel high voltage MOS driver being connected to said even side write driving circuit;

said writing pulse supplied in said first drive field being of opposite polarity to said writing pulse supplied in said second drive field.

2. The drive circuit for a thin-film electroluminescent (EL) matrix display panel of claim 1, further comprising:

first driving means for conducting said first drive field, said first driving means including, first activating means for turning on one of a plurality of MOS transistors included in said odd side N-channel high voltage MOS driver, each said MOS transistor being associated with an odd number scanning electrode, second activating means for turning on all of a plurality of MOS transistors included in said even side P-channel high voltage MOS driver;

second driving means for conducting said first drive field, said second driving means including, third activating means for turning on one of a plurality of MOS transistors included in said even side N-channel high voltage MOS driver, each said MOS transistor being associated with an even number scanning electrode, and fourth activating means for turning on all of a plurality of MOS transistors included in said odd side P-channel high voltage MOS driver;

third driving means for conducting said second drive field, said third driving means including, fifth activating means for turning on one of said plurality of MOS transistors included in said odd side P-channel high voltage MOS driver; and sixth activating means for turning on all of said plurality of MOS transistors included in said even side N-channel high voltage MOS driver; and fourth driving means for conducting said second drive field, said fourth means including, seventh activating means for turning on one of said plurality of MOS transistors included in said even side P-channel high voltage MOS driver; and eighth activating means for turning on all of said plurality of MOS transistors included in said odd side N-channel high voltage MOS driver.

3. A method of driving an electroluminescent matrix display panel having a plurality of pixels arranged in odd and even groups and defined by data electrodes and scanning electrodes, said scanning electrodes being arranged in alternating even and odd groups, selected ones of said pixels forming a display image on said display panel, comprising:

driving each said selected pixel by applying drive signals divided into odd and even fields to the said electrodes defining a said selected pixel by;

(a) driving the said electrodes defining said selected pixel in the odd field to apply write pulses having a first polarity thereto, and (b) driving the said electrodes defining said selected pixel in said even field to apply write pulses of a polarity opposite to the first polarity thereto;

said steps (a) and (b) of driving applying a said write pulse in said odd field and a said write pulse in said even field with a constant phase relationship therebetween to each said selected pixel throughout the display.

4. The method of claim 3 wherein each said odd field and each said even field are divided into a plurality of portions corresponding in number to the number of scan electrodes in said odd and even groups, each said portion of said odd field and a corresponding portion of said even field corresponding to a said scan electrode of said odd or even groups, said step (a) of driving applying a write pulse during said portion of said odd field to said corresponding scan electrode of said odd or even group;

said step (b) of driving applying a write pulse during said corresponding portion of said even field to said corresponding scan electrode of said odd or even group.

5. A method of driving an electroluminescent matrix display panel having a plurality of pixels defined by data electrodes and scanning electrodes; comprising:

driving said electrodes with drive signals divided into first and second fields by;

(a) driving said data electrodes and some of said scanning electrodes in a first field to apply write pulses to said pixels connected thereto; and (b) driving said data electrodes and said some of said scanning electrodes in a second field to apply write pulses having opposite polarity to said write pulses of step (a) to said pixels connected thereto, said step (a) of driving applying said write pulses to the pixels connected to each said scanning electrode at a time unique to each said scanning electrode driving said first field;

said step (b) of driving applying write pulses to the pixels connected to each said scanning electrode at a time unique to each said scanning electrode driving said second field;

said unique time in said first field and in said second field for each scanning electrode having a constant phase relationship therebetween.

6. A method of driving an electroluminescent matrix display panel having a plurality of pixels defined by data electrodes and scanning electrodes, said scanning electrodes being arranged in alternating first and second groups comprising:

(a) driving said display panel in a first frame by;

precharging all said pixels with a precharge voltage;

selecting a scanning electrode of said first group and at least one data electrode associated with desired pixels of a row of pixels to be displayed;

discharging all pixels not associated with said at least one data electrode associated with desired pixels to be displayed;

applying a first writing pulse of a first polarity to said desired pixels of said row of pixels associated with said selected scanning electrode and said selected at least one data electrode by applying a voltage directly to all said scanning electrodes of said second group, said selected scanning electrode being held to a ground level, said applied voltage pulling up said second group of scanning electrodes to form said first writing pulse; said first writing pulse, when superimposed on said precharge voltage being sufficient to initiate electroluminescence of said desired pixels of said row of pixels associated with said selected scanning and data electrodes, said first writing pulse being otherwise insufficient to initiate electroluminescence;

said steps of precharging, selecting, discharging, and applying being performed for each scanning electrode;

(b) driving said display panel in a second frame by;

precharging all said pixels with a precharge voltage;

discharging all pixels associated with said selected data electrode while retaining said precharge voltage on all said pixels associated with non-selected data electrodes; and applying a second writing pulse of a polarity opposite to said first writing pulse to said desired pixels of said row of pixels by applying a voltage directly to said selected scanning electrode, said non-selected scanning electrodes of said first and second groups being held to a ground level, said voltage pulling down said data electrodes and developing a net voltage across said desired pixels of said row of pixels which is sufficient to cause electroluminescence but developing a net voltage across the remainder of said pixels of the selected scanning electrode which is insufficient to cause electroluminescence of those precharged pixels associated with said non-selected electrodes;

said steps of precharging, discharging and applying being performed for each scanning electrode;

said method of driving thereby developing symmetrical first and second write pulses in first and second frames to develop the desired display.

7. The method of claim 3 wherein said write pulses supplied in said step (a) of driving and said step (b) of driving are of the same magnitude but of opposite polarities.

8. The method of claim 5 wherein said write pulses supplied in said step (a) of driving and said step (b) of driving are of the same magnitude but of opposite polarities.

9. The method of claim 6 wherein said write pulses supplied in said step (a) of driving and in said step (b) of driving are of the same magnitude but of opposite polarities.

10. The method of claim 9 wherein said step (a) of driving and said step (b) of driving alternately develop equispaced said write pulses.

11. A drive circuit for an electroluminescent matrix display panel having orthogonally arranged data and scanning electrodes intersecting to form a plurality of pixels, comprising:

data electrode drive circuit for driving said data electrodes to select pixels to be driven to luminescence associated with each scanning electrode;

scanning electrode drive circuit scanning said scanning electrodes, said scanning electrode drive circuit including, a P-channel and an N-channel driver associated with each scanning electrode, said P-channel and N-channel drivers enabling application of write voltage pulses of opposing polarities to each said scanning electrode.

12. The drive circuit of claim 11 wherein said scanning electrode drive circuit comprises means for supplying first and second write voltages of opposing polarities to each said selected pixel.

13. The drive circuit of claim 12 wherein said first and second write voltages are of the same amplitude but of opposing polarities.

14. The drive circuit of claim 13 wherein said means for supplying develops said first and second write voltages alternately and equispaced apart.

15. A system for driving an electroluminescent matrix display panel having a plurality of pixels arranged in odd and even groups and defined by data electrodes and scanning electrodes, said scanning electrodes being arranged in alternating even and odd groups, selected ones of said pixels forming a display image on said display panel, comprising:

means for driving each said selected pixel by applying drive signals divided into odd and even fields to the said electrodes defining a selected pixel, said means for driving including:

odd field driving means for applying write pulses in an odd field by driving the said electrodes defining said selected pixel to apply write pulses having a first polarity thereto, and even field driving means for applying write pulses in an even field by driving the said electrodes defining said selected pixel to apply write pulses of a polarity opposite to the first polarity thereto;

said odd and even field driving means applying a said write pulse in said odd field and a said write pulse in said even field with a constant phase relationship therebetween to each said selected pixel.

16. The system of claim 15 wherein said odd field driving means and said even field driving means develop their respective said write pulses with equal magnitudes but opposite polarities.

* * * * *